US005154430A

United States Patent [19]

Cozzolino

[11] Patent Number: 5,154,430

[45] Date of Patent: Oct. 13, 1992

[54] RING TOSS APPARATUS

[76] Inventor: Salvatore A. Cozzolino, 7820 Gordon Loop, Brooksville, Fla. 34601

[21] Appl. No.: 786,541

[22] Filed: Nov. 1, 1991

[51] Int. Cl.[5] ..... A63B 67/06

[52] U.S. Cl. ..... 273/327; 124/1; 124/79; 273/425

[58] Field of Search ..... 273/425, 327; 124/1, 124/10, 79

[56] References Cited

U.S. PATENT DOCUMENTS 1,975,724 10/1934 Jonas ..... 273/327

4,274,222 6/1981 Zahn et al. ..... 273/327 X

FOREIGN PATENT DOCUMENTS 2361132 4/1978 France ..... 124/1

26439 11/1907 United Kingdom ..... 273/327

*Primary Examiner*—Paul E. Shapiro

*Attorney, Agent, or Firm*—Hugh E. Smith

[57] ABSTRACT

A ring toss organization includes a rod member mounting a tether line thereto, wherein the tether line is cooperative with a torroidal ring member, wherein the ring member receives a loop formed by the tether line therethrough, whereupon sudden tensioning of the tether line effects projection of the ring relative to the tether line member.

3 Claims, 5 Drawing Sheets

RING TOSS APPARATUS

BACKGROUND OF THE INVENTION

1. Field of the Invention

The field of invention relates to ring toss structure, and more particularly pertains to a new and improved ring toss apparatus wherein the same is arranged for mounting a torroidal ring to a tether line by directing a loop of the tether line therethrough for projecting the ring relative to the tether line.

2. Description of the Prior Art

Various ring toss apparatus of different types are utilized in the prior art in an effort to project rings relative to an individual and project the ring relative to a target or alternatively project the ring for amusement and entertainment of individuals. Such apparatus is exemplified in U.S. Pat. No. 3,825,263 to Santeangelo wherein a rod is arranged to receive a ring resiliently projected from a support surface.

U.S. Pat. No. 4,687,210 to Michel sets forth a ring of resilient construction arranged for balancing relative to a support surface.

U.S. Pat. No. 4,329,807 to Atkinson sets forth an aerodynamically oriented ring adapted for spinning and throwing.

As such, it may be appreciated that there continues to be a need for a new and improved ring toss apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of ring toss apparatus now present in the prior art, the present invention provides a ring toss apparatus wherein the same is arranged for projection from a tether line upon tensioning of the tether line. As such, the general purpose of the present invention, which will be described subsequently in greater detail, is to provide a new and improved ring toss apparatus which has all the advantages of the prior art ring toss apparatus and none of the disadvantages.

To attain this, the present invention provides a ring toss organization including a rod member mounting a tether line thereto, wherein the tether line is cooperative with a torroidal ring member, wherein the ring member receives a loop formed by the tether line therethrough, whereupon sudden tensioning of the tether line effects projection of the ring relative to the tether line member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ring toss apparatus which has all the advantages of the prior art ring toss apparatus and none of the disadvantages.

It is another object of the present invention to provide a new and improved ring toss apparatus which may be easily and efficiently manufactured and marketed.

It is a further object of the present invention to provide a new and improved ring toss apparatus which is of a durable and reliable construction.

An even further object of the present invention is to provide a new and improved ring toss apparatus which is susceptible of a low cost of manufacture with regard to both materials and labor, and which accordingly is then susceptible of low prices of sale to the consuming public, thereby making such ring toss apparatus economically available to the buying public.

Still yet another object of the present invention is to provide a new and improved ring toss apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
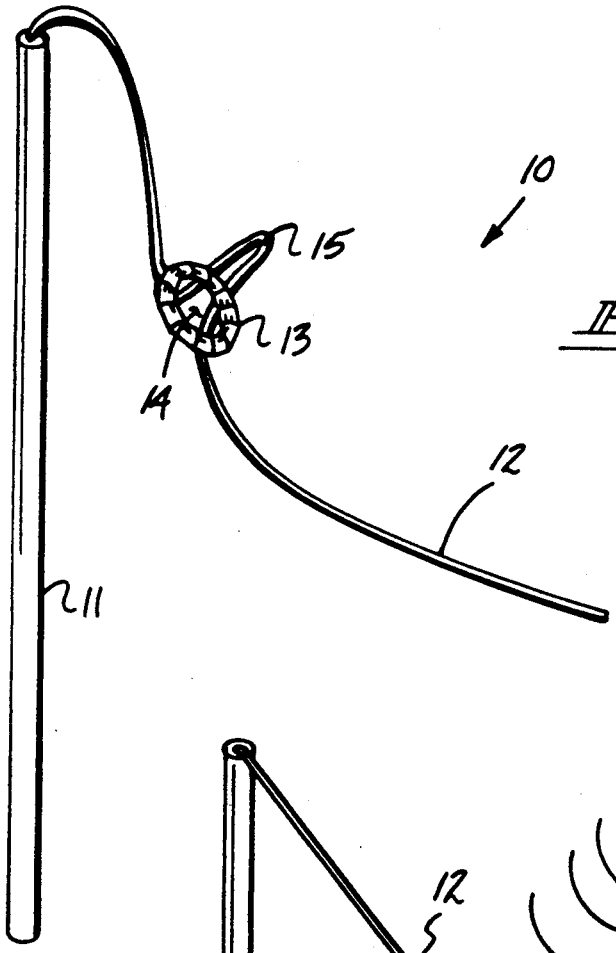
FIG. 1 is an isometric illustration of the invention in a first loaded position.
Figure 2:
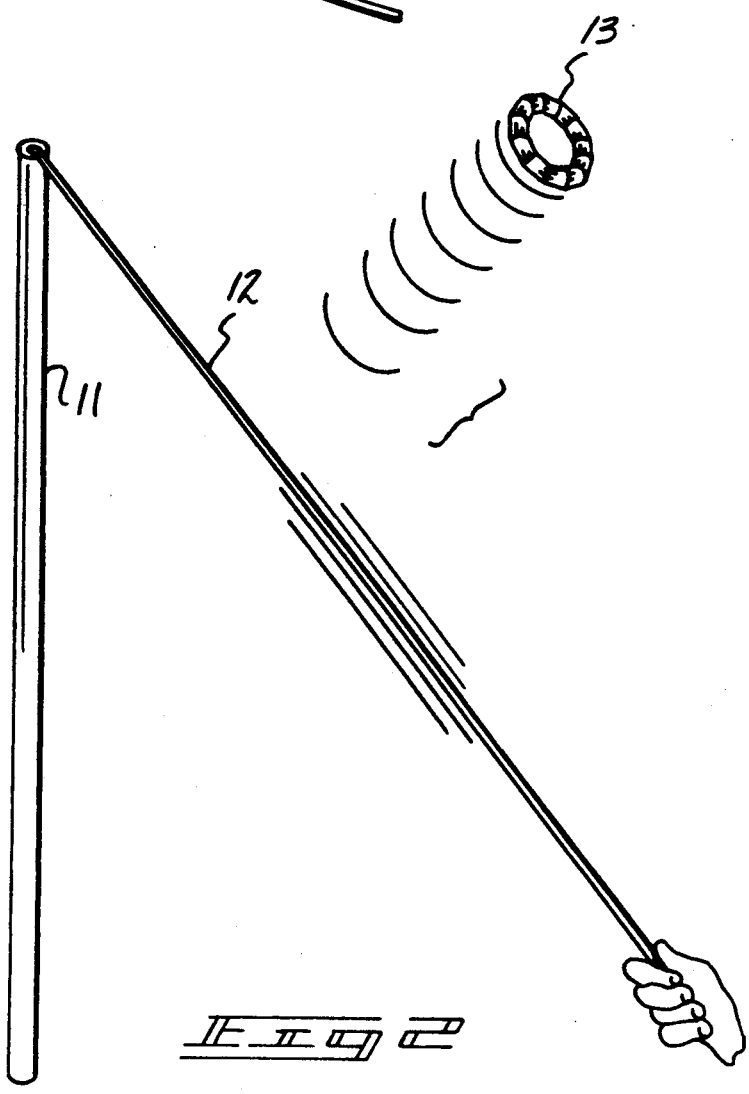
FIG. 2 is an isometric illustration of the invention in a second ejected position.
Figure 3:
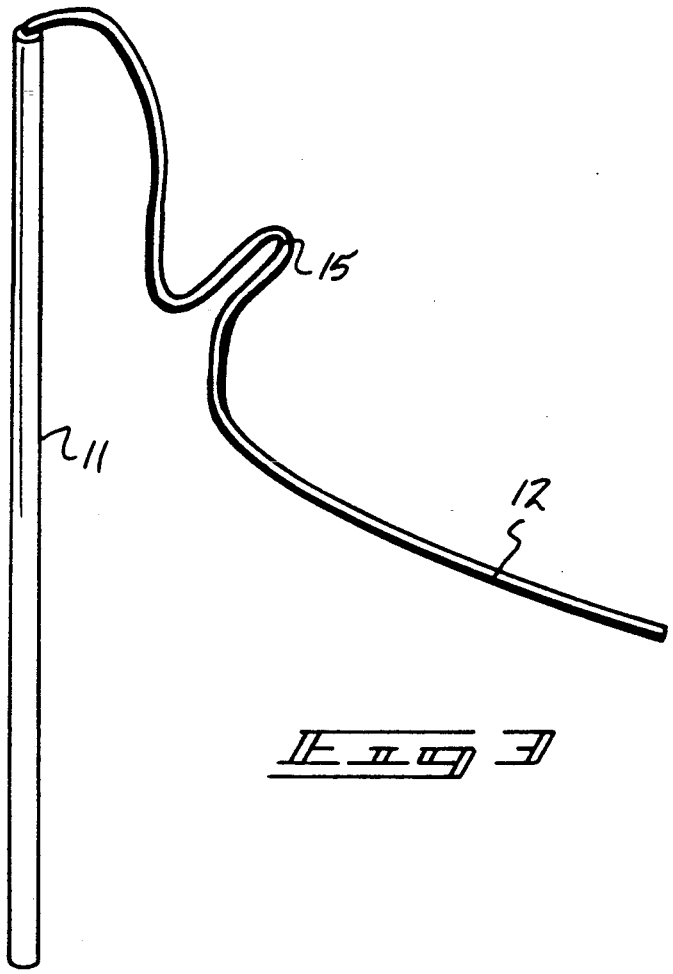
FIG. 3 is an isometric illustration of the support rod and tether line structure.
Figure 4:
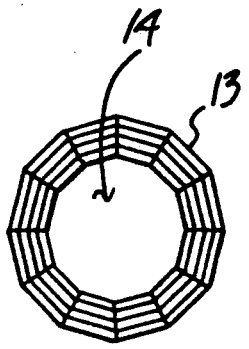
FIG. 4 is an orthographic front view of the ring member.
Figure 5:
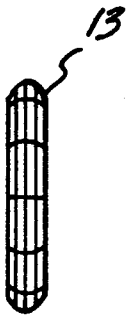
FIG. 5 is an orthographic side view of the ring member.

With reference now to the drawings, and in particular to FIGS. 1 to 10 thereof, a new and improved ring toss apparatus embodying the principles and concepts of the present invention and generally designated by the reference numeral 10 will be described.

Mores specifically, the ring toss apparatus 10 of the instant invention essentially comprises a rigid support rod 11, including an upper distal end mounting a flexible tether line 12 thereto. The flexible tether line 12 extends from the rigid support rod terminating at a tether line free distal end. A rigid torroidal ring 13 is provided formed with a ring central opening 14, whereupon a tether line loop 15 is formed and directed through the central opening 14, in a manner as illustrated in the FIG. 1. Upon firmly grasping or mounting the support rod 11 and by instantaneous tensioning of the flexible tether line 12 relative to the support rod 11, the ring 13 is hurled relative thereto. In this manner, the ring may be projected for the amusement of the user, or alternatively an individual may attempt to receive the ring upon the rigid support rod 11 by attempting project the rigid support rod 11 through the central opening 14 once the torroidal ring 13 is in flight.

Figure 6:
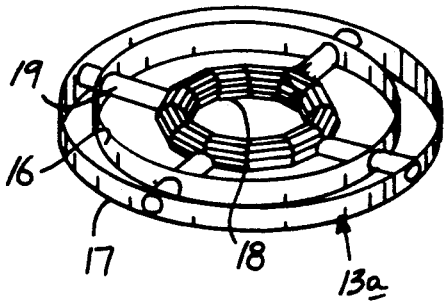
FIGS. 6 and 7 are isometric illustrations of modifications of the ring member.
Figure 7:
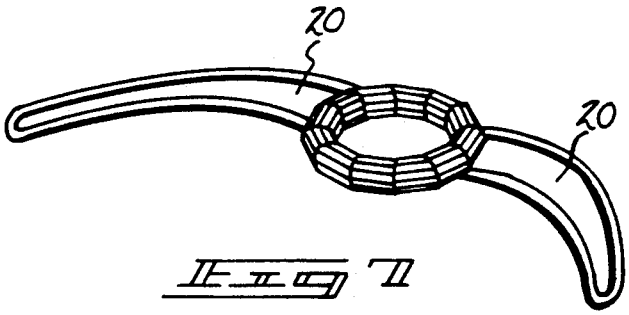

The FIGS. 6 and 7 illustrate the use of modified ring members, including diametrically opposed vanes 20, in a manner as illustrated in the FIG. 7, or alternatively an inner ring 16 is coaxially mounted within an outer ring 17 exteriorly of the central ring portion 18 utilizing radial legs 19 extending from the central ring portion 18 directed exteriorly thereof through the inner and outer rings 16 and 17 for forming a geometrically aligned member.

Figure 8:
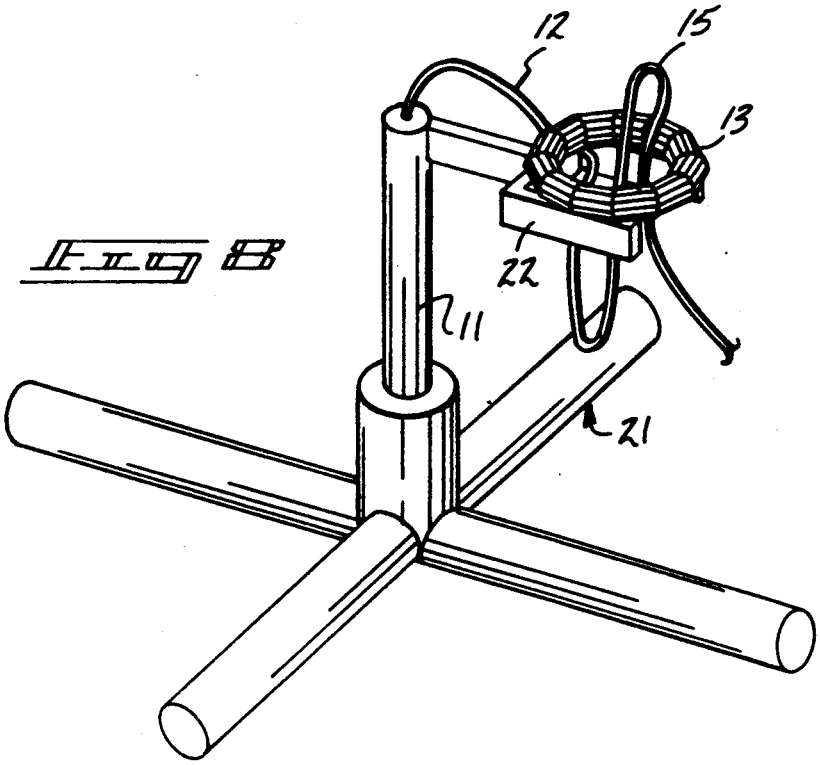
FIG. 8 is an isometric illustration of the support rod utilizing a support stand associated therewith.
Figure 9:
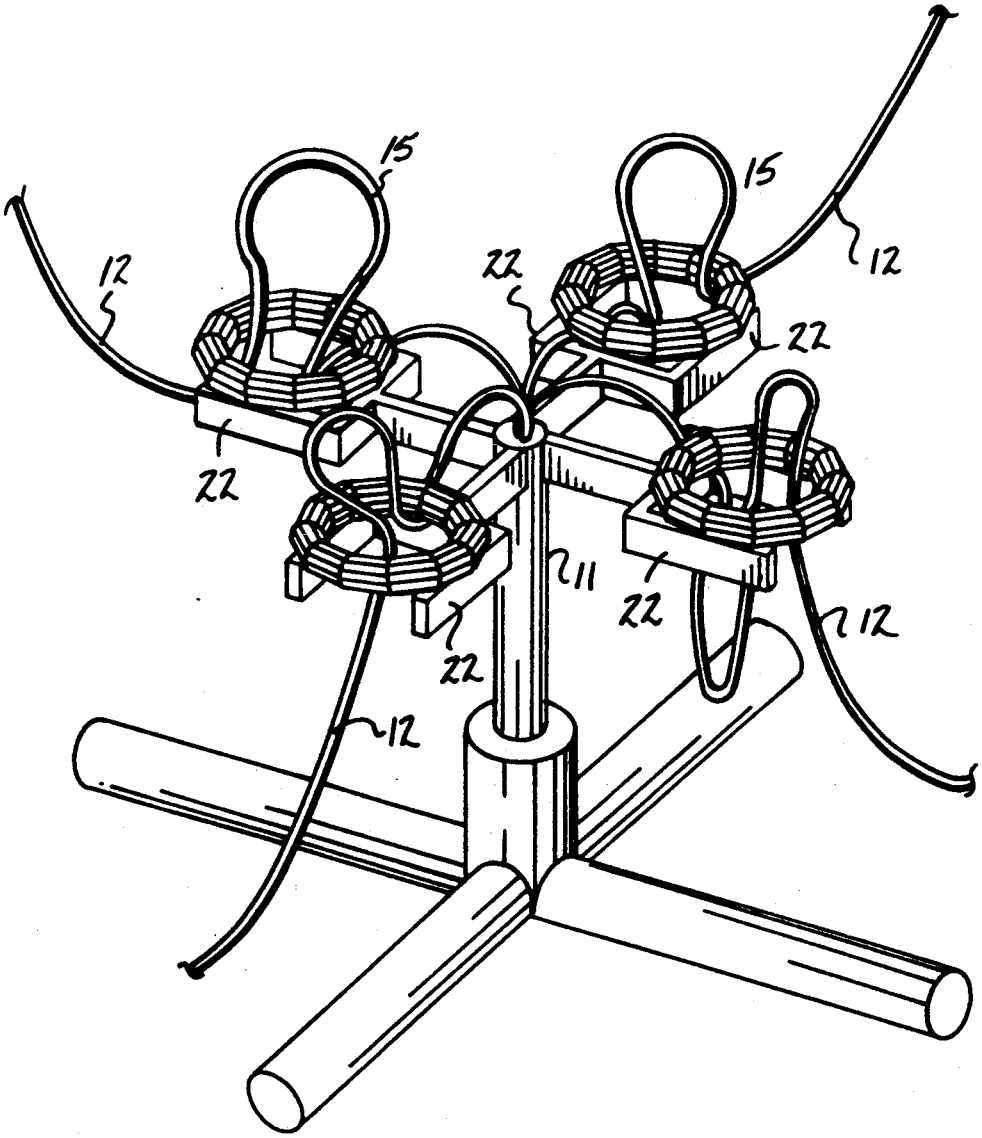
FIG. 9 is an isometric illustration of the support rod utilizing a plurality of support rods and ring members associated therewith for multiple projection of the ring members relative to the rod.

The FIG. 8 illustrates the use of a generally "U" shaped support holder 22 mounted in a radially projecting relationship relative to the support rod 11, that in turn is positioned upon a rod support stand 21 that is arranged for fixed securement to an underlying surface. The "U" shaped holder 22 defines spaced legs that are spaced apart a predetermined spacing substantially equal to a predetermined diameter of the ring 13 to position the ring 13 thereon. The FIG. 9 illustrates the use of a plurality of such holders extending radially relative to the rod 11 to permit instantaneous projection of a plurality of such rings relative to the rod for multiple projection of rings.

Figure 10:
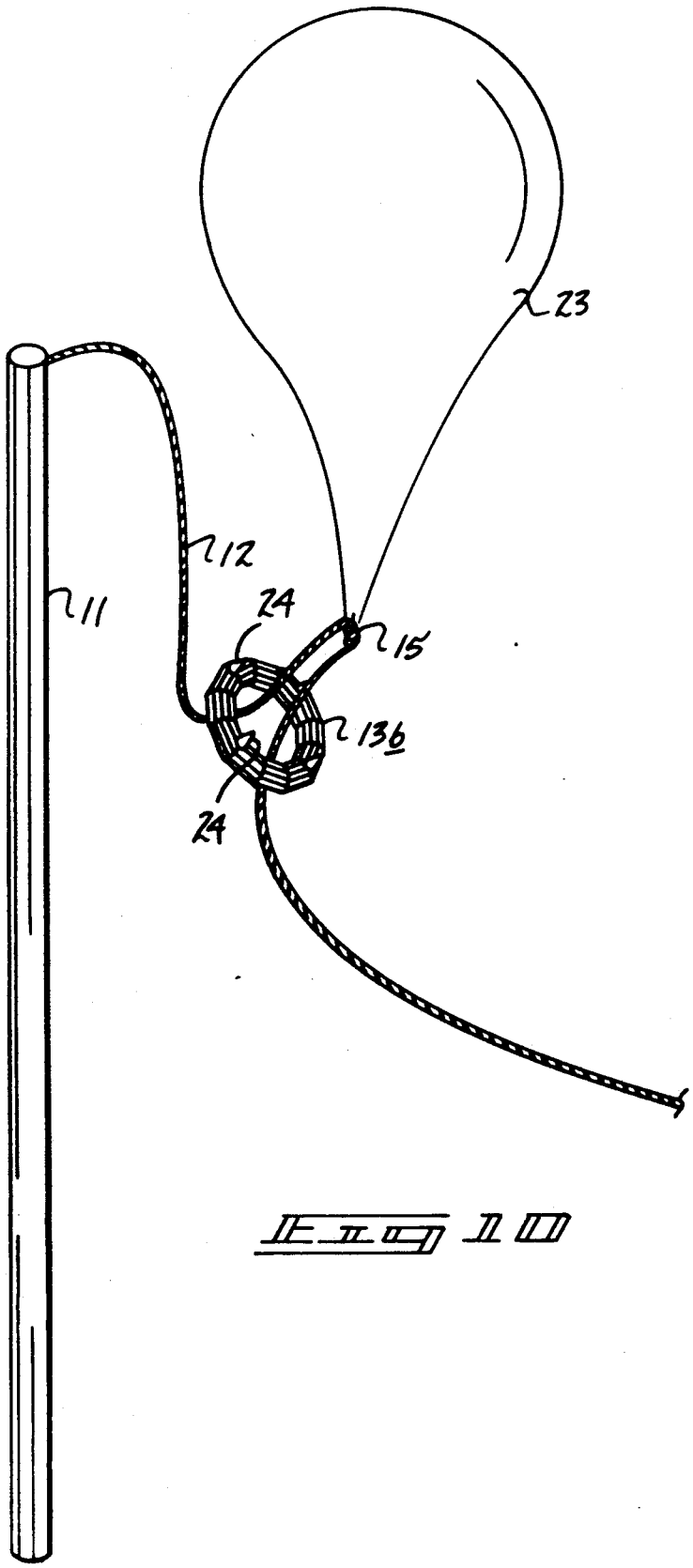
FIG. 10 is an isometric illustration of a modification of the ring member utilized by the invention.

FIG. 10 illustrates a modified ring structure 13*b* that includes a plurality of ring spikes 24 fixedly and integrally mounted to the ring projecting upwardly thereof, wherein the spikes are arranged in a parallel relationship relative to one another and parallel to an axis defined by the torroidal ring 13. A balloon 23 defined by a balloon diameter greater than the central opening diameter of the central opening 14 is mounted to the tether line loop 15, whereupon an individual must provide enhanced force to tension the tether line 12 thereby effecting a piercing of the balloon 23 prior to the ring being projected from the tether line 12 for an added degree of difficulty in utilization of the organization and amusement of individuals. Further it should be noted that each of the ring members 13, as illustrated in the FIG. 9 for example, may utilize the modified ring structure 13*b* positioned upon the holder, with a balloon 23 mounted to each of the loops 15 of a multiplicity of tether lines 12.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ring toss apparatus, comprising, a rigid support rod, the rigid support rod including a flexible tether line mounted to an upper distal end of the rigid support rod, the flexible tether line including a free distal end spaced from the rigid support rod, and a rigid torroidal ring defining a central opening therethrough, wherein the flexible tether line is formed with a tether line loop directed through the central opening, whereupon instantaneous tensioning of the tether line effects projection of the torroidal ring relative to the tether line.

2. An apparatus as set forth in claim 1 wherein the support rod includes a plurality of "U" shaped holders fixedly mounted to the rigid support rod extending radially relative to the rigid support rod, wherein the "U" shaped holders are arranged in a parallel relationship relative to one another, and each of the "U" shaped holders includes a plurality of spaced parallel legs, and including a further plurality of rigid torroidal rings in addition to the rigid torroidal ring for positioning at least one rigid torroidal ring on each "U" shaped holder, and the flexible tether line includes a further plurality of tether lines, and each tether line of the further plurality of tether lines and the tether line include a tether line loop, and at least one tether line loop is arranged for projection through each rigid torroidal ring to permit multiple projection of rigid torroidal rings relative to the rigid support rod.

3. An apparatus as set forth in claim 2 wherein each torroidal ring includes a plurality of ring spikes fixedly mounted to the ring, and the ring spikes are arranged in a parallel relationship extending upwardly relative to each torroidal ring, and each torroidal ring defines a ring axis, and each of the plurality of ring spikes of each rigid torroidal ring are arranged parallel relative to the ring axis, and each tether line loop directed through each torroidal ring includes a balloon member, the balloon member defined by balloon member diameter, and wherein the central opening of each torroidal ring defines a central opening diameter, and wherein the balloon diameter is greater than the central opening diameter.

* * * * *